US005734235A

United States Patent [19]

Noguchi

[11] Patent Number: 5,734,235

[45] Date of Patent: Mar. 31, 1998

[54] ELECTRON GUN WITH REDUCED ASTIGMATISM AND CURVATURE OF FIELD AND CRT EMPLOYING SAME

[75] Inventor: Kazunari Noguchi, Chiba, Japan

[73] Assignee: Hitachi, Ltd., Tokyo, Japan

[21] Appl. No.: 774,445

[22] Filed: Dec. 30, 1996

[30] Foreign Application Priority Data

Jan. 8, 1996 [JP] Japan ..... 8-774

[51] Int. Cl.[6] ..... G09G 1/04; H01J 29/46

[52] U.S. Cl. ..... 315/382; 315/382.1; 315/14; 315/368.15; 313/414

[58] Field of Search ..... 315/382, 382.1, 315/14, 15, 16, 368.15; 313/414

[56] References Cited

U.S. PATENT DOCUMENTS 4,886,999 12/1989 Yamane et al. ..... 313/414
5,170,101 12/1992 Gorski et al. ..... 315/368.11
5,610,481 3/1997 Shirai et al. ..... 315/382

*Primary Examiner*—Gregory C. Issing
*Attorney, Agent, or Firm*—Antonelli, Terry, Stout, & Kraus, LLP

[57] ABSTRACT

An electron gun for a cathode ray tube includes an accelerating electrode to be supplied with a maximum voltage, a focus electrode disposed adjacent to but spaced from the accelerating electrode, and a focus-corrective electrode adjacent to but spaced from the focus electrode. The accelerating electrode and the focus electrode form a first electron lens for focusing the electron beams stronger in a horizontal direction than in a vertical direction, and the focus-corrective electrode is configured so as to form a second electron lens by application thereto of a voltage lower than a voltage applied to the focus electrode in cooperation with the focus electrode for focusing the electron beams stronger in the vertical direction than in the horizontal direction, and is adapted to be supplied with a voltage increasing with increasing deflection of the electron beams but lower than the voltage applied to the focus electrode.

6 Claims, 8 Drawing Sheets

ELECTRON GUN WITH REDUCED ASTIGMATISM AND CURVATURE OF FIELD AND CRT EMPLOYING SAME

BACKGROUND OF THE INVENTION

The present invention relates to an electron gun for a cathode ray tube and a cathode ray tube employing the same, and particularly to an electron gun with reduced astigmatism and curvature of field for a cathode ray tube and a high definition cathode ray tube employing the same.

An electron gun used for picture tubes and display tubes needs to suitably control the shape of an electron beam spot on a screen area in accordance with the amount of deflection for obtaining a good focus characteristic and high resolution over the entire screen area.

The electron gun of this type has been disclosed, for example, in Japanese Patent Laid-open No. Hei 7-161309.

FIG. 7 is a schematic axial section view illustrating a configuration example of the prior art electron gun for a cathode ray tube disclosed in the above-described document; and FIGS. 8A and 8B are perspective views showing an electrostatic quadrupole electrode configuration shown in FIG. 7. In these figures, reference character K indicates a cathode; reference numeral 1 is a first electrode; 2 is a second electrode; 3 is a third electrode; 4 is a fourth electrode composed of a first sub-electrode 41 and a second sub-electrode 42; 5 is a fifth electrode; 6 is a sixth electrode; and 7 is a shield cup. Reference numeral 4-1 indicates a horizontal correction plate provided on the first sub-electrode 41 on the second sub-electrode 42 side thereof; 4-2 is a vertical correction plate provided on the second sub-electrode 42 on the first sub-electrode 41 side thereof; and 51 and 61 are astigmatism correction plates provided within the fifth electrode 5 and the sixth electrode 6, respectively.

Referring to FIG. 7, the fifth electrode 5 functions as a lower-potential electrode and the sixth electrode 6 functions as a higher-potential electrode, and a main lens is formed in a region between the fifth electrode 5 and the sixth electrode 6. The astigmatism correction plates 51 and 61 are disposed within the fifth electrode 5 and the sixth electrode 6 which form the main lens, respectively, and single horizontally elongated opening is provided at each of opposing ends of the fifth electrode 5 and the sixth electrode 6.

In this electron gun, an electrostatic quadrupole lens for correcting deflection defocusing is formed in a region between the first sub-electrode 41 and the second sub-electrode 42 which form the focus electrode 4.

The electrostatic quadrupole lens is formed of the horizontal correction plates 4-1 provided on the first sub-electrode 41 on the second sub-electrode 42 side thereof (see FIG. 8A) and the vertical correction plates 4-2 provided on the second sub-electrode 42 on the first sub-electrode 41 side thereof (see FIG. 8B), and it is disposed as shown in FIG. 7.

The horizontal correction plates 4-1 are composed of a pair of approximately rectangular plates disposed in such a manner as to vertically sandwich an electron beam aperture in the first sub-electrode 4-1, and the vertical correction plates 4-2 are composed of a plurality of approximately rectangular plates disposed in such a manner that the two adjacent plates horizontally sandwich each electron beam aperture in the second sub-electrode 42.

A fixed focus voltage $Vf_1$ is applied to the third electrode 3 and the second sub-electrode 42, and an AC voltage dVf varying in synchronization with the amount of deflection of electron beams and superposed on a fixed voltage $Vf_2$ is applied to the first sub-electrode 41 and the fifth electrode 5.

In this way, the curvature of field and astigmatism caused by deflection of electron beams have been corrected by the use of two focus voltages, one constant voltage $Vf_1$ applied to the third electrode 3 and the second sub-electrode 42 and another constant voltage $Vf_2$ applied to the first sub-electrode 41 and the fifth electrode 5, and a dynamic voltage $dV_f$ superposed on the voltage $Vf_2$.

In the electron gun disclosed in the above-described document, Japanese Patent Laid-open No. Hei 7-161309, as shown in FIG. 9, the constant voltage $Vf_1$ is set to be considerably larger than the constant voltage $Vf_2$ so that the differential voltage ($Vf_1$–$Vf_2$) exceeds at least the maximum value of the voltage $dV_f$.

With this arrangement, when the dynamic voltage dVf is increased, that is, when the amount of deflection of electron beams becomes larger, the strength of the electrostatic quadrupole lens formed between the first sub-electrode 41 and the second sub-electrode 42 becomes weak so that a lens action of the main lens stronger in the horizontal direction than in the vertical direction remains to correct the astigmatism. At the same time, differential potentials in the main lens, in a curvature-of-field correction lens formed between the third electrode 3 and the first sub-electrode 41, and in a curvature-of-field correction lens formed between the second sub-electrode 42 and the fifth electrode 5 become smaller, to lower the lens strength. Accordingly, a focusing force on deflected electron beams becomes weak, to thereby correct curvature of field.

With this electrode configuration and electrical configuration, a plurality of the curvature-of-field correction lenses can be obtained and thereby the sensitivity of the quadrupole lens can be increased, thereby making it possible to reduce the amplitude of the dynamic voltage and hence to suppress the increased circuit cost and the like.

With this configuration, astigmatism is corrected by controlling the cross-sectional shape of deflected electron beams, to thereby provide a color cathode ray tube having higher resolving power.

Ranges and typical values of voltages applied to the electron gun for a cathode ray tube shown in FIG. 7 are as follows:

| | ranges | typical values |
|---|---|---|
| Eb | 20 kV–40 kV | 30 kV |
| Vf1 | 4 kV–12 kV | 8.4 kV |
| Vf2 | 3 kV–11 kV | 7.6 kV |
| dVf | 0 V–2 kV | 0–800 V |
| Ec2 | 200 V–2 kV | 750 V |
| Ec1 | −50 V–50 V | 0 V |

In the above-described prior art, the fifth electrode is disposed adjacent to but spaced from the final accelerating electrode. The focus electrode adjacent to but spaced from the fifth electrode is divided into the first sub-electrode and the second sub-electrode to form a non-axially-symmetric lens or a lens non-circular in cross-section between the first sub-electrode and the second sub-electrode. A voltage varying in synchronization with deflection of electron beams is applied to the first sub-electrode and the fifth electrode, to deform the cross-sectional shape of an electron beam, thus correcting astigmatism due to deflection of the electron beam. At the same time, the lens strength of the main lens is changed in synchronization with deflection of electron beams by the fifth electrode and also the strengths of the curvature-of-field correction lenses between the third electrode and the first sub-electrode and between the second sub-electrode and the fifth electrode are changed, to correct curvature of field at a periphery of the screen.

In a color cathode ray tube, generally, a final accelerating voltage Eb, which is the maximum voltage in a range of from 20 to 40 kV, is supplied from an anode button embedded in a funnel, and other voltages are supplied from stem pins provided in a stem. An electron gun most typically used for a cathode ray tube needs to be supplied with, in addition to the final accelerating voltage Eb, eight kinds of voltages: a focus voltage Vf in a range of from 3 to 12 kV; a voltage Ec2 to be applied to the second electrode in a range of from 200 to 2 kV; a voltage Ec1 to be applied to the first electrode in a range of −50 to 50 V; positive and negative poles of a heater voltage Ef in a range of 4 to 8 V; and voltages EkR, EkG and EkB corresponding to three color cathodes in a range of from 0 to 250 V, and consequently the electron gun requires at least eight stem pins. FIG. 10 is a schematic view, seen from a phosphor screen side, showing an arrangement of stem pins typically used for color cathode ray tubes of a neck diameter of about 29 mm. In this arrangement, ten stem pins are arranged on a circumference of about 7.5 mm in radius, through which ten kinds of voltages can be applied to an electron gun at maximum. A pin 101 is supplied with a focus voltage $V_f$; pins 104 and 105 are connected to each other within the cathode ray tube and are supplied with a voltage Ec1; pins 106, 108 and 1011 are supplied with voltages EkG, EkR and EkB, respectively; a pin 107 is supplied with a voltage Ec2; and pins 109 and 1010 are connected with positive and negative poles of a voltage Ef, respectively. With this stem arrangement, a withstand voltage between the adjacent stem pins is about 2 kV at maximum in consideration of manufacturing variations and reliability in operation. Each pin, other than the pin 101, is supplied with only 2 kV at maximum, and accordingly, it sufficiently ensures electrical insulation from the adjacent pins, but the pin 101 is supplied with the $V_f$ in a range of from 3 to 12 kV and thereby two pin locations are not utilized on both sides of the pin 101 to ensure electric insulation. However, for the prior art electron gun described with reference to FIG. 7, the focus voltage $Vf_2+dV_f$ varying in synchronization with beam deflection in a range of from 3 to 12 kV needs to be supplied as well as the fixed focus voltage $Vf_1$ of from 4 to 12 kV. As a result, the stem pin arrangement shown in FIG. 10 could not supply the two kinds of the voltages $Vf_1$ and $(Vf_2+dV_f)$. Namely, to supply the two voltages $Vf_1$ and $Vf_2$, a special stem shown in FIG. 11 was used, in which the pins 111 and 112 are spaced wider than the regular spacing from the other pins. In the stem pin arrangement shown in FIG. 11, the pin 111 is supplied with the fixed focus voltage $Vf_1$ and the pin 112 is supplied with the voltage $(Vf_2+dV_f)$ varying in synchronization with beam deflection, and the other pins are supplied with the voltages in the same manner as in the stem arrangement in FIG. 10, that is, the pin 115 is supplied with the voltage Ec1 of from −50 to 50 V; the pins 116, 118 and 1111 are respectively supplied with the voltages EkG, EkR and EkB in a range of from 0 to 250 V; the pin 117 is supplied with the voltage Ec2 of from 200 V to 2 kV; and the pin 119 and 1110 are respectively supplied with the positive and negative poles of the voltage Ef in a range of from 4 to 8 V. In addition, the replacement of the stem pin arrangement shown in FIG. 10 with that shown in FIG. 11 causes a problem that a socket receiving the stem pins needs to have a special structure, resulting in the increasing cost.

SUMMARY OF THE INVENTION

An object of the present invention is to provide an electron gun for a cathode ray tube capable of reducing the number of the kinds of high voltages of 2 kV or more supplied via stem pins to only one, thereby obtaining a good image quality at the periphery of the screen using a conventional stem and a conventional socket.

To achieve the above object, according to the present invention, there is provided an electron gun for a cathode ray tube, including:

first electrode means for generating and directing a plurality of electron beams along initial paths parallel to each other in a horizontal plane toward a phosphor screen; and second electrode means for forming a main lens for focusing the plurality of electron beams on the phosphor screen.

The second electrode means comprises an accelerating electrode to be supplied with a maximum voltage, a focus electrode disposed adjacent to but spaced from the accelerating electrode, and a focus-corrective electrode adjacent to but spaced from the focus electrode. The accelerating electrode and the focus electrode form a first electron lens for focusing the plurality of electron beams stronger in a horizontal direction than in a vertical direction, and the focus-corrective electrode is configured so as to form a second electron lens by application thereto of a voltage lower than a voltage applied to the focus electrode in cooperation with the focus electrode for focusing the plurality of electron beams stronger in the vertical direction than in the horizontal direction, and is adapted to be supplied with a voltage increasing with increasing deflection of the plurality of electron beams but lower than the voltage applied to the focus electrode.

BRIEF DESCRIPTION OF THE DRAWINGS

In the drawings, which form an integral part of the specification, and are to be read in conjunction therewith, and in which like reference numerals designate similar components throughout the figures, and in which.

DETAILED DESCRIPTION OF THE PREFERRED EMBODIMENTS

The present invention provides an electron gun for a cathode ray tube. An accelerating electrode supplied with a maximum voltage and a focus electrode adjacent to but spaced from the accelerating electrode form an electron lens for focusing the electron beams stronger in a horizontal direction than in a vertical direction. A focus-corrective electrode is disposed adjacent to but spaced from the focus electrode, is configured so as to form another electron lens by application thereto of a voltage lower than a voltage applied to the focus electrode in cooperation with the focus electrode for focusing the electron beams stronger in a vertical direction than in a horizontal direction, and is adapted to be supplied with a voltage increasing with increasing deflection of the electron beams but lower than a voltage applied with the focus electrode. When the electron beams are undeflected, a focusing action stronger in the horizontal direction than in the vertical direction by the electron lens formed between the final accelerating electrode supplied with the maximum voltage and the focus electrode adjacent to but spaced from the final accelerating electrode, cancels out a focusing action stronger in the vertical direction than in the horizontal direction by the electron lens formed between the focus electrode and the focus-corrective electrode supplied with a voltage lower than that applied to the focus electrode, to provide an approximately circular beam spot at the center of the screen.

When the electron beams are deflected, since a differential potential between the focus electrode and the focus-corrective electrode becomes small, the focusing action stronger in the vertical direction than in the horizontal direction by the electron lens formed therebetween becomes weaker than that at the time when the electron beams are undeflected, and thereby it loses the balance against the focusing action stronger in the horizontal direction than in the vertical direction by the electron lens formed between the final accelerating electrode supplied with the maximum voltage and the focus electrode adjacent to but spaced from the accelerating electrode. As a result, the focusing action stronger in the horizontal direction than in the vertical direction remains on the electron beams and it cancels out the focusing action stronger in the vertical direction than in the horizontal direction by magnetic deflection field, to correct astigmatism due to deflection, improving resolution at the periphery of the screen, thereby providing a good image quality over the entire screen area.

Hereinafter, preferred embodiments of the present invention will be described in detail with reference to the drawings.

Figure 1:
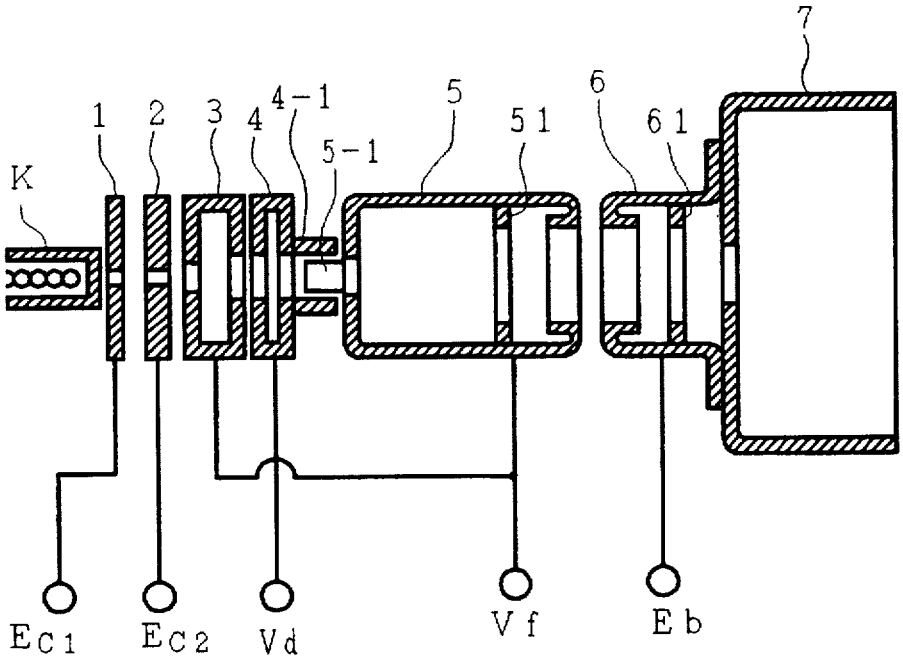
FIG. 1 is a schematic axial section view of a three beam in-line type electron gun illustrating one embodiment of an electron gun for a cathode ray tube according to the present invention.

FIG. 1 is a schematic axial section view of a three-beam in-line type electron gun illustrating one embodiment of an electron gun for a cathode ray tube according to the present invention. In this figure, reference character K indicates a cathode; reference numeral 1 is a first electrode; 2 is a second electrode; 3 is a third electrode; 4 is a fourth electrode (focus-corrective electrode); 5 is a fifth electrode (focus electrode); 6 is a sixth electrode (final accelerating electrode); and 7 is a shield cup. Reference numeral 4-1 indicates a horizontal correction plate; 5-1 is a vertical correction plate electrode and 51 and 61 are astigmatism correction plate electrodes disposed within the fifth electrode 5 and the sixth electrode 6, respectively.

In FIG. 1, the cathode K, the first electrode 1 and the second electrode 2 form first electrode means (triode portion); and the third electrode 3, the fourth electrode 4, the fifth electrode 5, and the sixth electrode form second electrode means. A maximum voltage Eb is applied to the final accelerating electrode 6, and a main lens is formed between opposing ends of the final accelerating electrode 6 and the focus electrode (fifth electrode) 5. The main lens produces a focusing action stronger in the horizontal direction than in the vertical direction on electron beams.

The focus electrode (fifth electrode) 5 has three circular electron beam apertures disposed at its end portion opposed to the fourth electrode 4, and vertical correction plates 5-1 are disposed on horizontally opposed sides of each of the electron beam apertures. On the other hand, the fourth electrode 4 has three circular electron beam apertures disposed at its end surface opposed to the focus electrode (fifth electrode) 5, and horizontal correction plates 4-1 extending toward the fourth electrode 4 are disposed above and below the electron beam apertures.

The fourth electrode 4 is supplied with a voltage Vd in a range of about 0 to 2 kV, which is lower than a focus voltage Vf applied to the focus electrode (fifth electrode) 5 and is increased with an increasing amount of deflection of the electron beams.

Accordingly, the number of the kinds of high focus voltages (for example, 2 kV or more) to be supplied via stem pins are reduced to only one, so that the electron gun for use in a cathode ray tube such as a picture tube or a display tube eliminates the need for any special stem and any special socket for supplying a voltage thereto.

When electron beams are undeflected, the focusing action stronger in the horizontal direction than in the vertical direction by the main lens cancels out the focusing action stronger in the vertical direction than in the horizontal direction by an electrostatic quadrupole lens formed between the fourth electrode 4 and the focus electrode (fifth electrode) 5, to provide an approximately circular beam spot at the center of the screen.

On the other hand, when the electron beams are deflected, the focusing action by the electrostatic quadrupole lens becomes weaker than that at the time when the electron beams are undeflected and it loses the balance against the focusing action stronger in the horizontal direction than in the vertical direction by the main lens, so that the focusing action stronger in the horizontal direction than in the vertical direction by the main lens remains on the electron beams. As a result, the focusing action stronger in the vertical direction than in the horizontal direction by magnetic deflection field is canceled out, and thereby the astigmatism due to magnetic deflection field is corrected.

Moreover, when the electron beams are deflected, a differential potential between the fourth electrode 4 and the third electrode 3 becomes smaller, and thereby the strength of the lens therebetween becomes weak, and accordingly a distance between the main lens and the electron beam focusing point becomes longer, as a result of which the electron beams can be focused even at the periphery of the screen, to thereby provide a good image quality over the entire screen.

Figure 2:
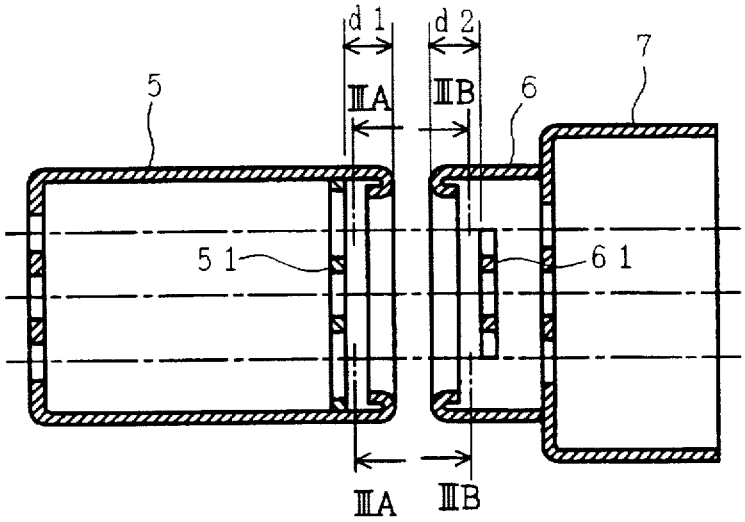
FIG. 2 is a horizontal sectional view of the major elements illustrating a main lens portion in the embodiment of the electron gun for a cathode ray tube according to the present invention.
Figure 3A:
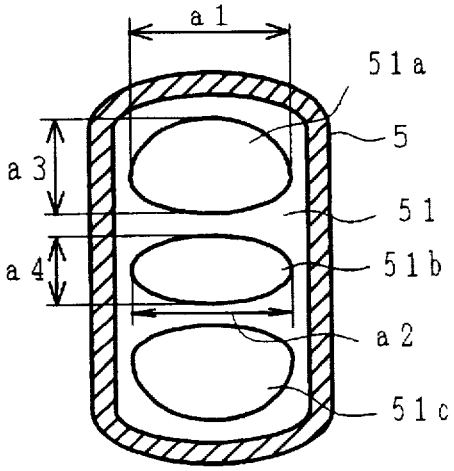
FIG. 3A is a cross-sectional view taken along line IIIA—IIIA of FIG. 2.
Figure 3B:
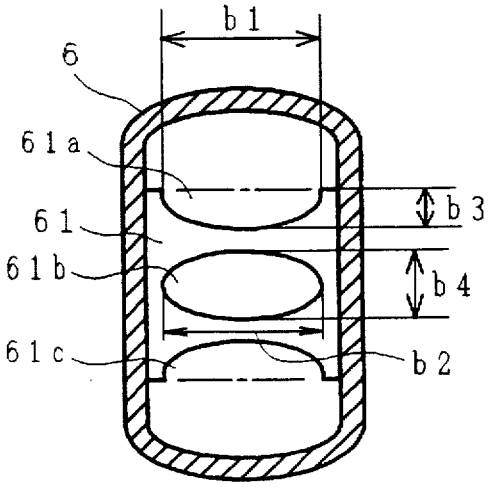
FIG. 3B is a cross-sectional view taken along line IIIB—IIIB of FIG. 2.

FIG. 2 is a horizontal sectional view of the major elements illustrating a configuration example of a main lens portion in one embodiment of an electron gun for a cathode ray tube according to the present invention; and FIGS. 3A and 3B are cross-sectional views of the main elements, wherein FIG. 3A is a cross-sectional view taken along line IIIA—IIIA of FIG. 2 and FIG. 3B is a cross-sectional view taken along line IIIB—IIIB of FIG. 2.

In FIG. 2 and FIGS. 3A and 3B, an astigmatism correction electrode 51 provided in the fifth electrode 5 has an electron beam aperture 51*b* through which a center electron beam passes and electron beam apertures 51*a* and 51*c* through which side electron beams pass, the apertures 51*a*, 51*b* and 51*c* being arranged in line; and an astigmatism correction electrode 61 provided in the sixth electrode 6 has an electron beam aperture 61*b* through which the center electron beam passes and electron beam apertures 61*a* and 61*c* through which the side electron beams pass, the apertures 61*a*, 61*b* and 61*c* being arranged in line.

Each of the electron beam apertures 51*a*, 51*b*, 51*c*, 61*a*, 61*b* and 61*c* is formed in an approximately oval shape having a vertical major axis, and a single opening in each of the opposing ends of the focus electrode (fifth electrode) 5 and the final accelerating electrode 6 has a horizontal major axis.

With this structure, the focusing action can be made stronger in the horizontal direction than in the vertical direction by optimizing a set back amount $d_1$ of the astigmatism correction electrode 51 from an end of the fifth electrode 5 facing the accelerating electrode (sixth electrode) 6; a set back amount $d_2$ of the astigmatism correction electrode 61 from an end of the sixth electrode 6 facing the focus electrode (fifth electrode) 5; a horizontal diameter $a_3$ and a vertical diameter $a_1$ of each of the apertures 51*a* and 51*c*; a horizontal diameter $a_4$ and a vertical diameter $a_2$ of the aperture 51*b*; a horizontal width $b_3$ and a vertical diameter $b_1$ of each of the cutouts 61*a* and 61*c*; and a horizontal diameter $b_4$ and a vertical diameter $b_2$ of the aperture 61*b*.

Figure 4A:
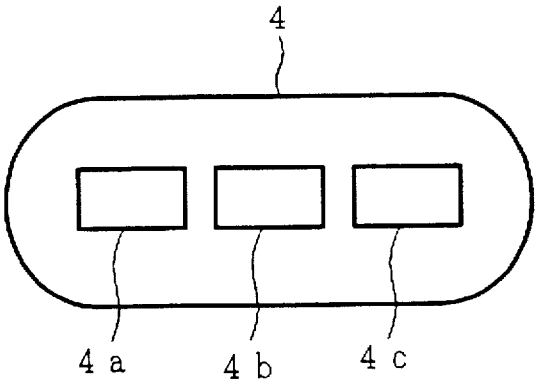
FIGS. 4A and 4B are front views of a focus-corrective electrode and a focus electrode in another embodiment of the electron gun for a cathode ray tube according to the present invention, respectively.
Figure 4C:
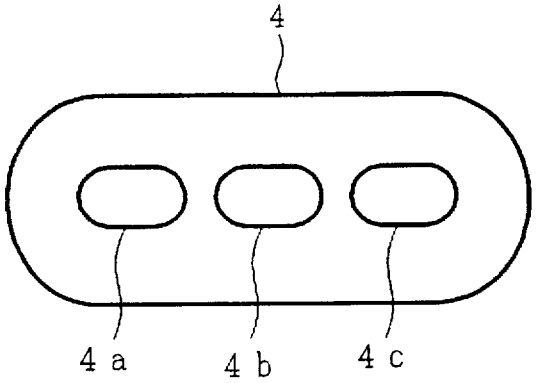
FIGS. 4C and 4D are front views of a focus-corrective electrode and a focus electrode in a further embodiment of the electron gun for a cathode ray tube according to the present invention, respectively.
Figure 4B:
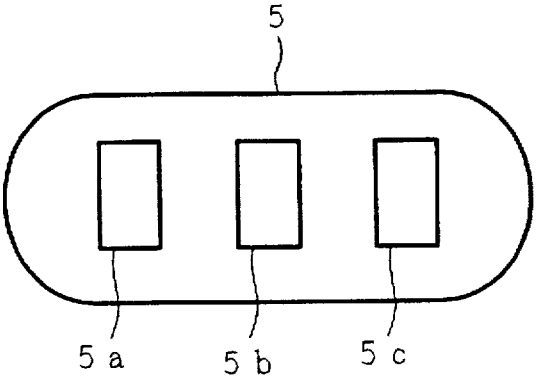
Figure 4D:
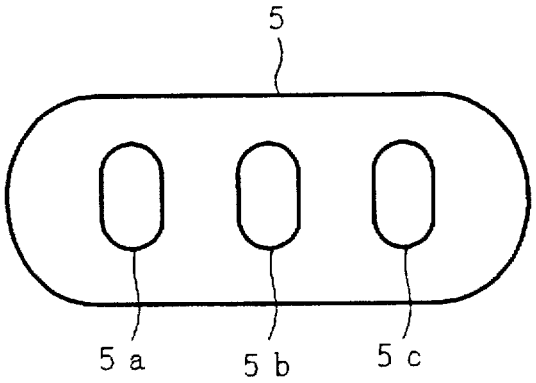

FIGS. 4A and 4B are front views illustrating a configuration example of an electrostatic quadrupole lens in another embodiment of the electron gun for a cathode ray tube according to the present invention, wherein FIG. 4A is a front view, seen from the focus electrode (fifth electrode) 5 side, of the fourth electrode; and FIG. 4B is a front view, seen from the fourth electrode side, of the focus electrode (fifth electrode) 5. The same electrodes as those shown in FIG. 1 are omitted in FIGS. 4A and 4B.

As shown in FIG. 4A, the fourth electrode 4 has three horizontally elongated electron beam apertures 4*a*, 4*b* and 4*c* each having a horizontal major axis at an end thereof facing the focus electrode (fifth electrode) 5; while as shown in FIG. 4B, the focus electrode (fifth electrode) 5 has three vertically elongated electron beam apertures 5*a*, 5*b* and 5*c* each having a vertical major axis at an end thereof facing the fourth electrode 4.

With this electrode configuration, an electron lens for focusing electron beams stronger in the vertical direction than in the horizontal direction is formed between the opposing portions of the fourth electrode 4 and the focus electrode (fifth electrode) 5, whereby the electron beams are focused stronger in the vertical direction and enter the main lens portion.

The main lens formed between the opposing portions of the focus electrode (fifth electrode) 5 and the final accelerating electrode (sixth electrode) 6 shown in FIG. 2 focuses the incident electron beams stronger in the horizontal direction, thus providing the same effect as that described with reference to FIG. 1.

In addition, the same effect can be obtained by replacing the fourth electrode 4 shown in FIG. 4A with a fourth electrode 4, shown in FIG. 4C, having three oval electron beam apertures 4*a*, 4*b* and 4*c* each having a horizontal major axis and also replacing the focus electrode (fifth electrode) 5 shown in FIG. 4B with a focus electrode (fifth electrode) 5, shown in FIG. 4B, having three oval electron beam apertures 5*a*, 5*b* and 5*c* each having a vertical major axis.

Figure 5:
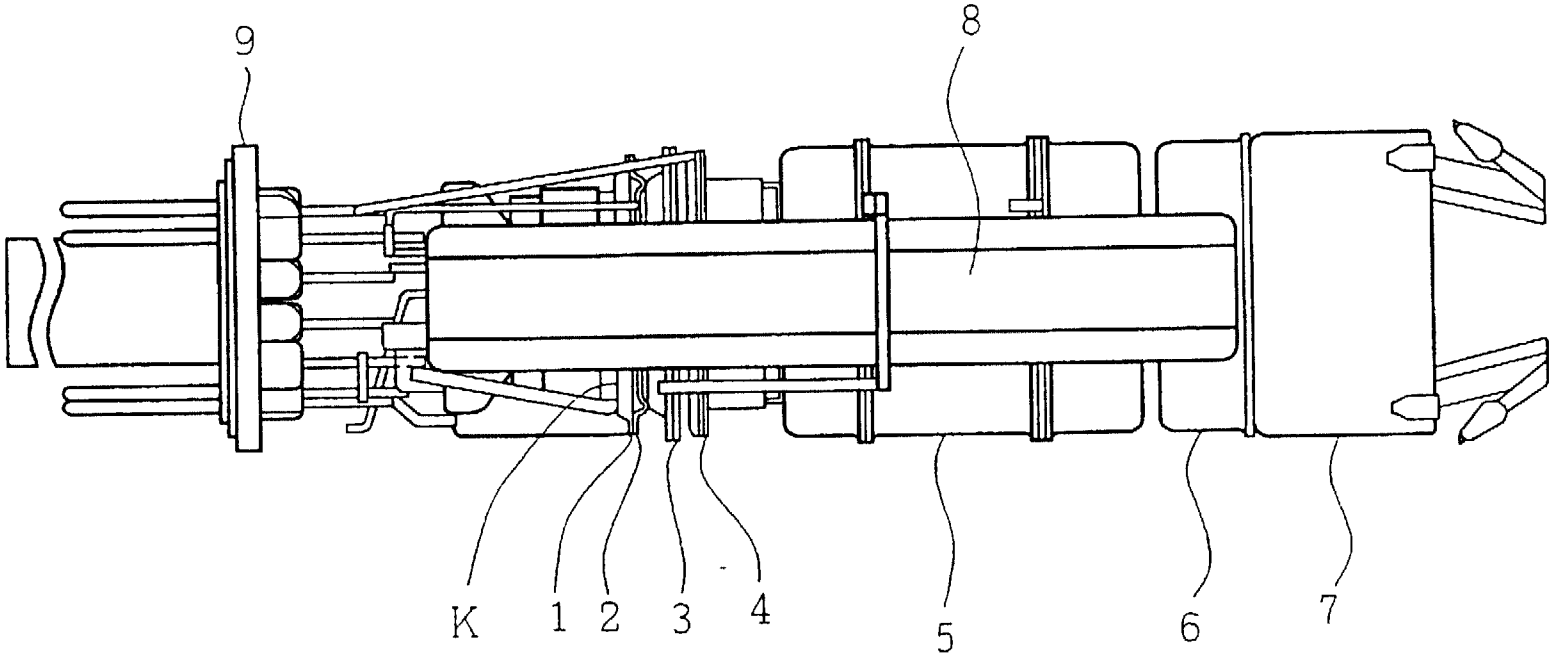
FIG. 5 is a side view illustrating the entire configuration of one embodiment of an electron gun for a cathode ray tube according to the present invention.

FIG. 5 is a side view illustrating the entire configuration of one embodiment of the electron gun for a cathode ray tube according to the present invention. In this figure, reference character K indicates a cathode; reference numeral 1 is a first electrode; 2 is a second electrode; 3 is a third electrode; 4 is a fourth electrode; 5 is a fifth electrode (focus electrode); 6 is a sixth electrode (accelerating electrode); 7 is a shield cup; 8 is a glass rods (beading glass) for retaining the electrodes in precise relationship; and 9 is a stem.

In FIG. 5, the cathode K, the first electrode 1 and the second electrode 2 form a triode portion; the first to fourth electrodes form a pre-focus lens; and the fifth electrode (focus electrode) 5 and the sixth electrode (accelerating electrode) 6 form a main lens.

The shield cup 7 is connected to the sixth electrode 6 for fixing contact springs for centering the electron gun within the neck portion and getters.

Figure 10:
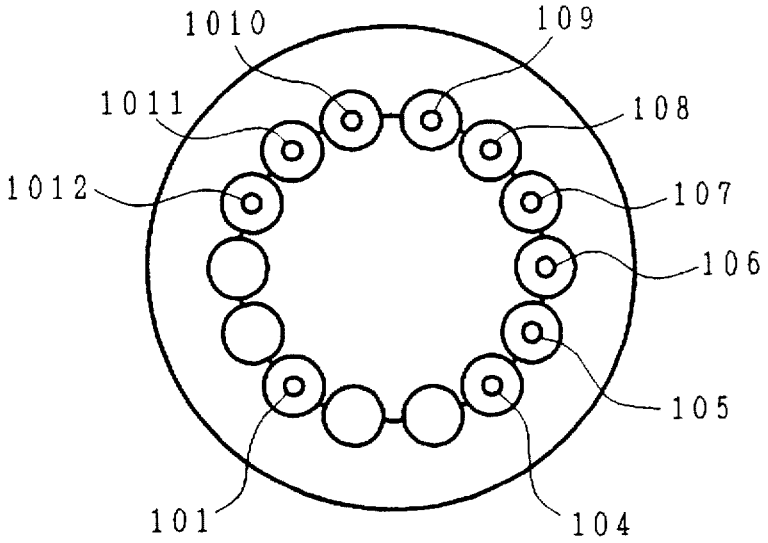
FIG. 10 (PRIOR ART)
FIG. 10 is a schematic view showing a typical stem pin arrangement for a color cathode ray tube having a neck diameter of about 29 mm.
Figure 11:
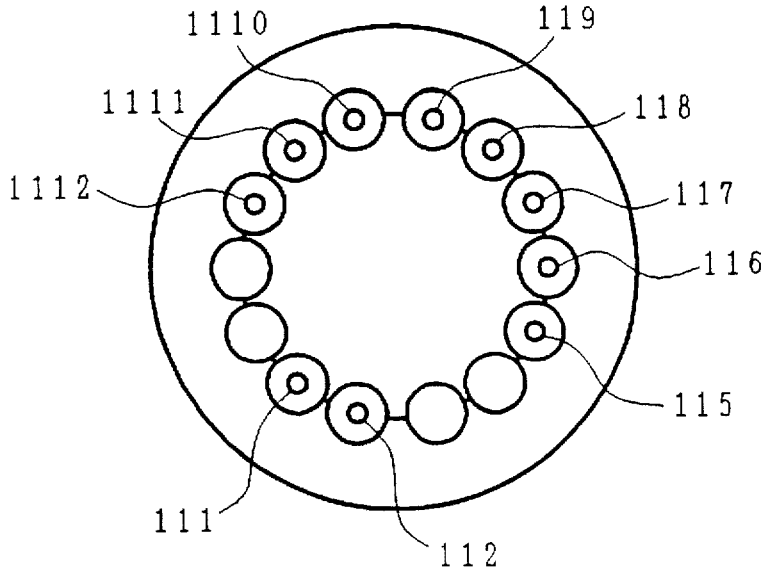
FIG. 11 (PRIOR ART)
FIG. 11 is a schematic view showing a special stem pin arrangement for supplying two kinds of high focus voltages.

With this configuration, voltages applied to the respective electrodes are as follows: a final accelerating voltage (maximum voltage) Eb is 30 kV; a focus voltage Vf is 8.4 kV; a voltage Ec2 applied to the second electrode is 750 V; a voltage Ec1 applied to the first electrode is 0 V; a voltage Vd applied to the fourth electrode and varying in synchronization with beam deflection is 0–1 kV; cathode voltages EkR, EkG and EkB are 0–200 V; and a heater voltage Ef is 6.3 V. Accordingly, the voltage more than 2 kV is only one kind, that is, the focus voltage Vf, as a result of which the above voltages can be supplied via stems in the stem pin arrangement shown in FIG. 10. More specifically, the pin 101 is supplied with the focus voltage Vf; the pin 104 is supplied with the voltage Vd varying in synchronization with beam deflection; the pin 105 is supplied with the voltage Ec1; the pins 106, 108 and 1011 are supplied with the voltages EkG, EkR and EkB, respectively; and the pins 109 and 1010 are supplied with the positive and negative poles of the voltage Ef, respectively. Namely, the above voltages can be supplied by the use of the ordinary stem as shown in FIG. 10, that is, without the need for any special stem as shown in FIG. 11. In addition, the voltages applied to respective electrodes are not limited to those shown in this embodiment, and may be changed depending on the size of the cathode ray tube and on the dimensions of electrodes of the electron gun. In some cases, the final accelerating voltage Eb is set at 20–40 kV; the focus voltage Vf is 4–12 kV; the voltage Ec2 is 200 V–2 kV; the voltage Ec1 is −50 V–50 V; the voltage Vd is 0–2 kV, the voltages EkR, EkG and EkB are 0–250 V; and the voltage Ef is 4–8 V.

Figure 6:
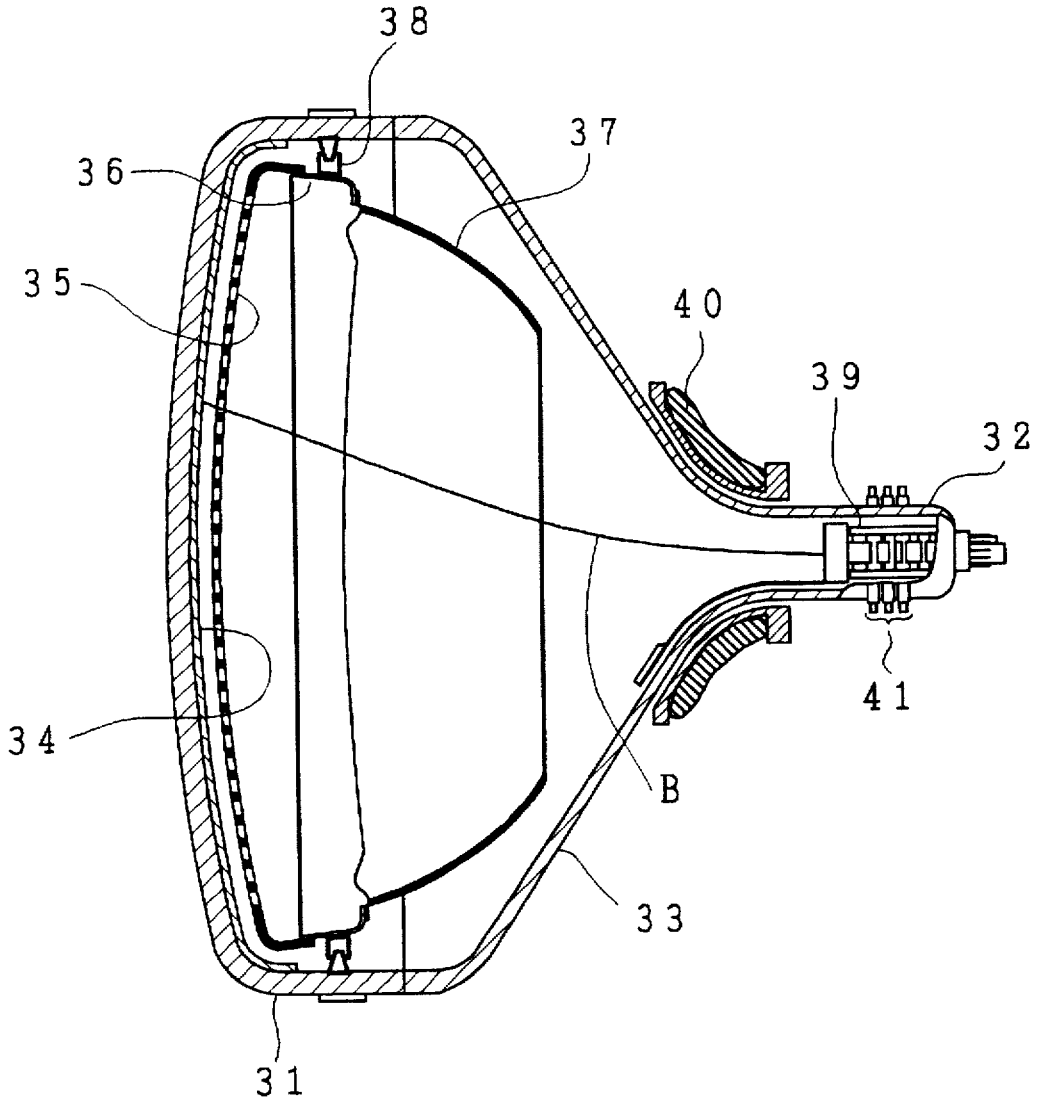
FIG. 6 is a sectional view illustrating a structure of a color cathode ray tube as one embodiment of the cathode ray tube of the present invention.
Figure 7:
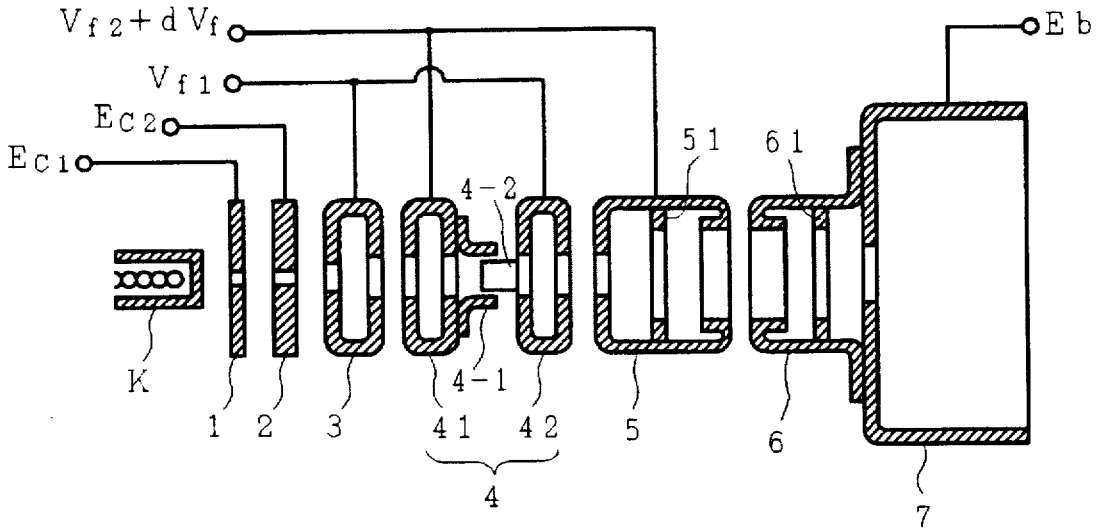
FIG. 7 (PRIOR ART)
FIG. 7 is a schematic axial section view illustrating a configuration example of a prior art electron gun for a cathode ray tube.
Figure 8A:
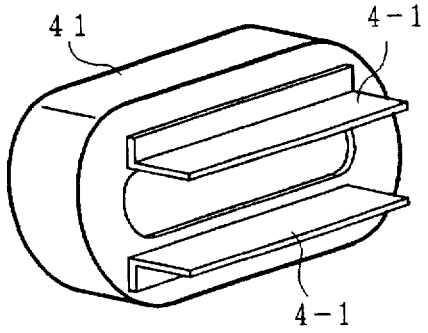
FIG. 8A (PRIOR ART)
FIGS. 8A and 8B are perspective views of a first sub-electrode and a second sub-electrode of the electron gun shown in FIG. 7, respectively.
Figure 8B:
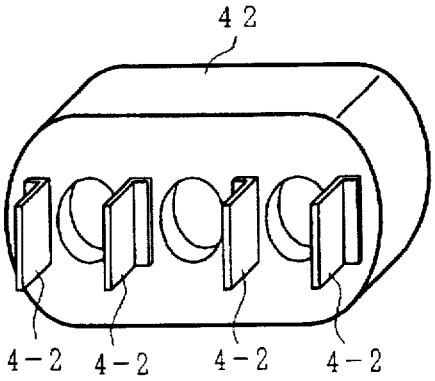
FIG. 8B (PRIOR ART)
Figure 9:
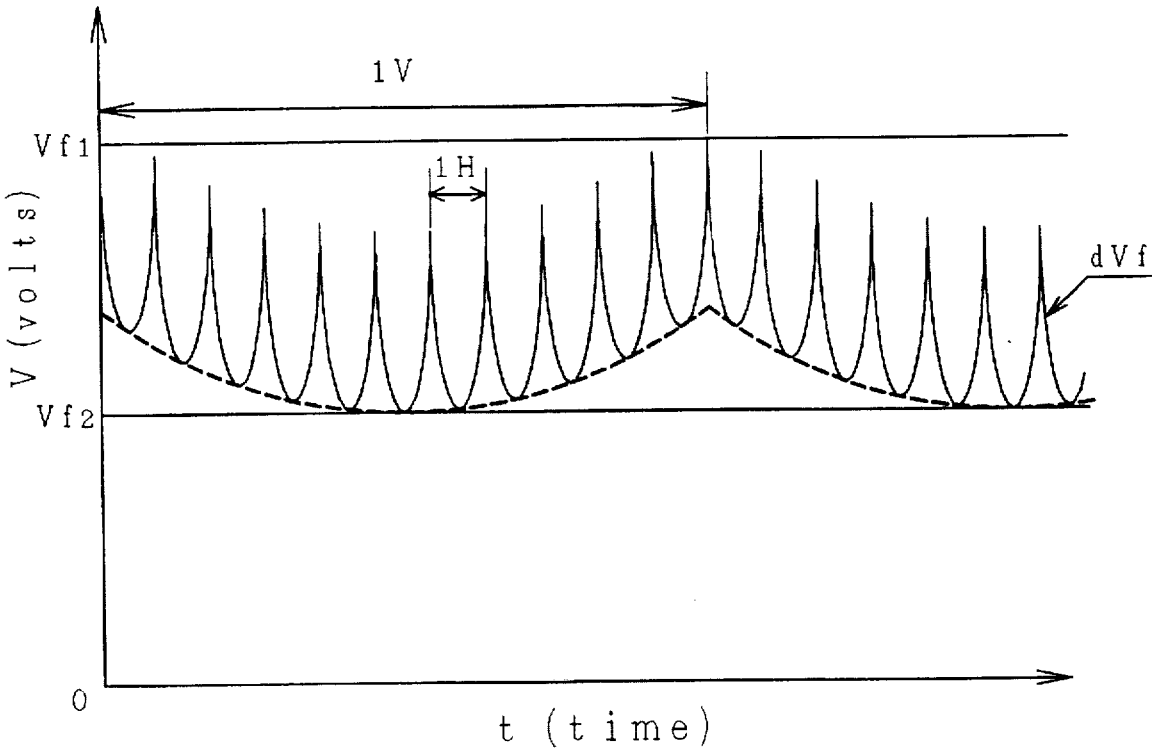
FIG. 9 (PRIOR ART)
FIG. 9 is a diagram showing a waveform of a dynamic voltage applied to a focus electrode.

FIG. 6 is a sectional view illustrating a structure of a color cathode ray tube as one embodiment of the cathode ray tube according to the present invention. In this figure, reference numeral 31 indicates a panel portion forming an imaging screen; 32 is a neck portion accommodating an electron gun; 33 is a funnel portion connecting the panel portion to the neck portion; 34 is a phosphor film forming a screen on the inner surface of the panel portion; 35 is a shadow mask; 36 is a mask frame holding the shadow mask; 37 is a magnetic shield shielding an external magnetic field; 38 is a suspension spring; 39 is the electron gun of the present invention; 40 is a deflection device; 11 is magnets for centering and purity adjustment; and reference character B is three in-line electron beams.

The color cathode ray tube of this type has an evacuated envelope including the panel portion 31 having the phosphor film 34 forming an imaging screen on the inner surface of the panel portion 31, the neck portion 32 accommodating the electron gun 39, and the funnel portion 33 connecting the neck portion 32 to the panel portion 31.

The electron gun 39 accommodated in the neck portion 32 has the above-described configuration in the previous embodiments, and it projects three in-line electron beams toward the phosphor screen 34.

The three electron beams emitted from the electron gun 39 are deflected in both the horizontal and vertical directions by the deflection device 40 mounted exteriorly of the transition region between the funnel portion 33 and the neck portion 32 of the evacuated envelop, are subjected to color selection by the shadow mask 35, and impinge on the phosphor film 34 to form a color image.

The shadow mask 35 is welded to the mask frame 36, and is disposed at a desired spacing apart from the phosphor screen 34 by engagement of the suspension springs 38 fixed at peripheral portions of the mask frame 36 with the panel pins embedded in the inner wall of the panel porion 31.

According to the cathode ray tube in this embodiment, it is possible to obtain a high resolution display over the entire screen area.

The present invention is not limited to the above-described embodiments, and it may be of course applied to electron guns of other types, to cathode ray tubes or color cathode ray tubes having the electron guns, and to other cathode ray tubes.

As described above, according to the present invention, a focus-corrective electrode is disposed adjacent to a focus electrode and it is supplied with a voltage lower than that applied to the focus electrode and increasing with an increasing amount of deflection of electron beams, so that it is possible to reduce the number of the high focus voltage stem pins to only one and also to perform the dynamic focusing at a low voltage. As a result, there can be obtained an electron gun for a cathode ray tube having a high resolution without the need for any special stem and socket for supplying a high voltage to the high resolution electron gun, and a cathode ray tube excellent in imaging quality using the electron gun.

What is claimed is:

1. An electron gun for a cathode ray tube, comprising:

first electrode means for generating and directing a plurality of electron beams along initial paths parallel to each other in a horizontal plane toward a phosphor screen; and second electrode means for forming a main lens for focusing said plurality of electron beams on said phosphor screen;

said second electrode means comprising an accelerating electrode to be supplied with a maximum voltage, a focus electrode disposed adjacent to but spaced from said accelerating electrode, and a focus-corrective electrode adjacent to but spaced from said focus electrode;

said accelerating electrode and said focus electrode forming a first electron lens for focusing said plurality of electron beams stronger in a horizontal direction than in a vertical direction; and said focus-corrective electrode being configured so as to form a second electron lens by application thereto of a voltage lower than a voltage applied to said focus electrode in cooperation with said focus electrode for focusing said plurality of electron beams stronger in the vertical direction than in the horizontal direction, and being adapted to be supplied with a voltage increasing with increasing deflection of said plurality of electron beams but lower than the voltage applied to said focus electrode.

2. An electron gun for a cathode ray tube according to claim 1, wherein a pair of vertical correction plates vertically sandwiching said plurality of electron beams are disposed on said focus-corrective electrode on a side thereof facing said focus electrode and a pair of horizontal correction plates horizontally sandwiching said plurality of electron beams are disposed on said focus electrode on a side thereof facing said focus-corrective electrode, to form said second electron lens.

3. An electron gun for a cathode ray tube according to claim 1, wherein said focus electrode has on a focus-corrective electrode side thereof a plurality of substantially oval or rectangular electron beam apertures, each having a vertical major axis, corresponding to said plurality of electron beams and said focus-corrective electrode has on a focus electrode side thereof a plurality of substantially oval or rectangular electron beam apertures, each having a horizontal major axis, corresponding to said plurality of electron beams, to form said second electron lens.

4. A cathode ray tube employing said electron gun for a cathode ray tube according to claim 1.

5. A cathode ray tube employing said electron gun for a cathode ray tube according to claim 2.

6. A cathode ray tube employing said electron gun for a cathode ray tube according to claim 3.

* * * * *